United States Patent [19]

Phillips

[11] 4,008,807

[45] Feb. 22, 1977

[54] DISPLAY DEVICE PARTICULARLY SUITABLE FOR SHOES

[76] Inventor: Geoff Phillips, 2 W. 45th St., New York, N.Y. 10036

[22] Filed: June 2, 1975

[21] Appl. No.: 582,701

Related U.S. Application Data

[63] Continuation-in-part of Ser. No. 553,172, Feb. 26, 1975, abandoned.

[52] U.S. Cl. ..... 211/34; 211/88; 248/224.4; 248/298; 211/90; 211/94; 211/153; 211/162

[51] Int. Cl.[2] ..... A47F 7/08

[58] Field of Search ..... 211/88, 90, 94, 105.1, 211/126, 128, 129, 131, 133, 134, 135, 162, 34–38, 148, 153, 175, 42, 43, 71–73, 87; 108/27, 59, 102, 137; 248/223, 225, 214, 121, 127, 146, 152, 298, 300, 307, 309, 346, 172, 226, 316, 117.2

[56] References Cited

UNITED STATES PATENTS

| | | | |
|---|---|---|---|
| 2,067,095 | 1/1937 | Pease | 211/34 |
| 2,098,828 | 11/1937 | Ludwick | 211/162 X |
| 2,371,433 | 3/1945 | Davis | 211/162 X |
| 2,695,105 | 11/1954 | Mitchell | 211/94 X |
| 3,067,882 | 12/1962 | Ribbens | 211/148 X |

*Primary Examiner*—Roy D. Frazier
*Assistant Examiner*—Terrell P. Lewis
*Attorney, Agent, or Firm*—Roberts & Cohen

[57] ABSTRACT

A display device is provided in the form of pairs of similar article supporting sections supported by a guide or rail or other equivalent support, the sections having adjustable spacing relative to each other. Each section includes a base with a flange accommodated in one of the guides, there being lateral and front lips arranged on adjacent sides of the base to form a box-like structure. With respect to two adjacent sections of this type an aritcle such as a shoe can be supported by such sections spaced either vertically or horizontally apart. Two or more such sections can also be arranged in a train to provide retaining walls for one another. A plurality of guide rails forming part of a framework can be vertically spaced in parallel relationship and the rails may be arranged in two parallel vertical arrays between which is wedged a panel which framework may or may not be telescopically arranged relative to a housing. The panel constitutes both a backdrop and a device to resist torsional stresses on the associated guides or rails.

13 Claims, 6 Drawing Figures

DISPLAY DEVICE PARTICULARLY SUITABLE FOR SHOES

CROSS REFERENCE TO OTHER APPLICATIONS

This application is a continuation-in-part of my earlier filed copending application, Ser. No. 553,172, filed on Feb. 26, 1976, now abandoned.

FIELD OF THE INVENTION

This invention relates to display devices, mechanisms and assemblies and, more particularly, to display means which are particularly suitable for displaying articles such as shoes, slippers, sandals, boots and the like.

BACKGROUND

There is available a storage and display arrangement which employs a plurality of panels arranged side-by-side and having mounted thereon display devices for exhibiting goods for the purposes of sale and the like. In this arrangement, at least one such panel is displaceable from a storage area to a display zone in order to display goods arranged thereupon in advantageous manner. One such means for making the panels displaceable consists of the provision of a telescopic support extensible from the storage zone. This provides for bringing such panels back and forth between the storage zone and the display zone.

The above-described arrangement is now commercially available and is not a part of the present invention except for the fact that it provides a suitable vehicle for employing devices which are designed in accordance with the invention. In fact, the present invention is in part provided for the purpose of affording suitably advantageous substitutes with respect to the means presently employed for mounting articles for display on panels of the aforenoted type.

For example, in one known construction, the aforesaid panels are fabricated of peg board and pegs are displaceably and selectively mounted on the peg board in order to constitute supports for shoes and the like. Another arrangement is to provide receptacles for shoes and the like which are affixed to the aforesaid panels by means of Velcro coupling devices. Further it is known to provide box-shaped holders which are screwed onto the above-mentioned panels in affixed alignment. Still further it is known to provide complete shelves with partitions which are mounted on panels of the above-noted type.

While the above noted arrangements have certain advantages such as being in part adjustable, in many other respects they have been found unsatisfactory. For example, the peg board arrangement does not find wide commercial acceptance because peg boards are not considered particularly decorative. Furthermore, the pegs become loosened in the holes provided therefor and can fall out thereby causing the supported articles to fall out of the display arrangement. The Velcro design provides for a high degree of adjustability with respect to positioning, but the Velcro does not supply a sufficiently fast mounting to avoid a breaking away of the article supports.

Some other arrangements which are superior to the constructions mentioned hereinabove are to be found in my copending application Ser. No. 553,172 filed Feb. 26, 1975, the contents of which application are embodied herein.

SUMMARY OF THE INVENTION

It is an object of the invention to provide an improved display device which is readily usable both on static and movable shoe merchandising devices and the like including but not limited to racks, display panels, suspended shelves, fixed shelves and so forth.

It is another object of the invention to provide an improved display device which can house articles such as shoes in different attitudes and which can be extended to accommodate articles of different sizes.

A further object of the invention is to provide improved article supporting sections which are adapted for cooperating in horizontal or vertical alignment for the supporting of articles therebetween, while being also capable of being utilized to provide retaining walls for one another Yet another object of the invention is to provide an improved article display device which allows substantial flexibility with respect to the sizes of the articles to be displayed.

Yet another object of the invention is to provide an improved display device which is readily affixed to a support by means of guides rails and the like in connection with a panel which serves both as a backdrop and as a means for relieving torsional forces on the guides.

Still another object of the invention is to provide an improved means for displaying shoes of all types including but not limited to shoes with heels, flat shoes, wedge-type shoes and so forth without resulting in any imbalance in weight distribution.

Yet another object of the invention is to provide an improved display which creates a neat, pleasing, aesthetic and prestigious exposure of articles such as shoes and the like.

Still another object of the invention is to provide an improved display which does not require a particular direction of alignment for the articles being displayed thereupon.

Yet another object of the invention is to provide an improved display which, if desired, avoids the look of a continuous shelf.

Still a further object of the invention is to provide an improved display which avoids displacement of the article being displayed if the display is handled roughly.

In accordance with one embodiment of the invention, there is provided an article display comprising adjustably related sections, one of said sections being a mirror image of the other, the sections being suitable for being paired in either horizontal or vertical alignments and with selected spacing therebetween, like sections being furthermore adapted to provide retainer walls for one another is so desired.

According to the invention, support means may be provided to hold these sections in adjustably fixed and spaced relationship. The support means may, for example, include a guide and or rail and the aforesaid sections will include means for slidingly engaging a guide for adjustment purposes.

According to another feature of the invention, there may be provided a framework including a plurality of guides such as the guide mentioned above, these being held in generally horizontal position.

These guides may in accordance with another important feature of the invention be arranged in two parallel arrays between which is wedged a panel serving as a backdrop and as a device to relieve forces on the guides.

The above and other objects, features and advantages of the invention will be found more particularly in the detailed description which follows hereinafter as illustrated in the accompanying drawing.

DETAILED DESCRIPTION

Figure 1:
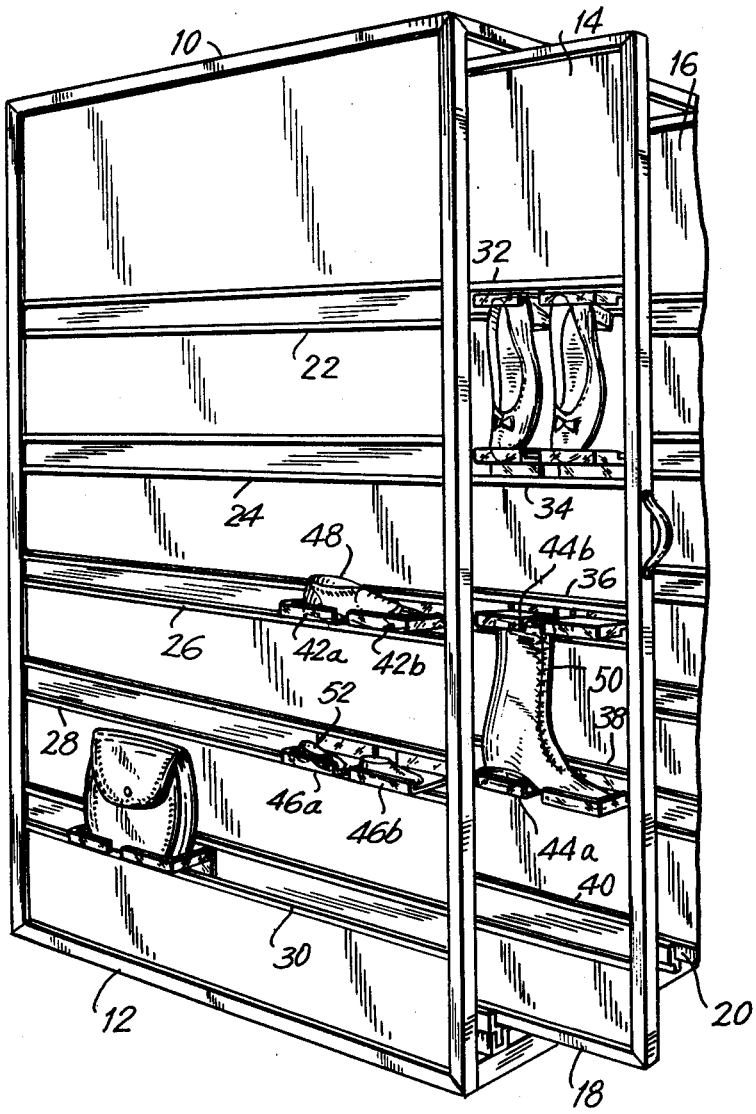
FIG. 1 is a perspective view of part of a telescopic display means of the prior art employing, however, the article support or display sections of the invention in different arrangements.

In FIG. 1 appears a housing generally indicated at 10 with a side wall 12 included in the housing and with a plurality of panels such as indicated at 14 and 16 being telescopically arranged with respect to the housing by means of the provision of rails 18 and 20.

Guides or channels are generally indicated at 22, 24, 26, 28 and 30 on side wall 12 and by way of example at 32, 34, 36, 38 and 40 on telescopically arranged panel 14.

In accordance with the invention, a plurality of article support sections can be arranged in a variety of manners such as indicated at 42*a* and *b*, 44*a* and *b* and 46*a* and *b*. These pairs of sections are cooperatively arranged so that a pair of such sections jointly support articles such as shoes or the like which are indicated by way of example at 48, 50 and 52, or so that individual sections provide retainer walls for one another.

Figure 2:
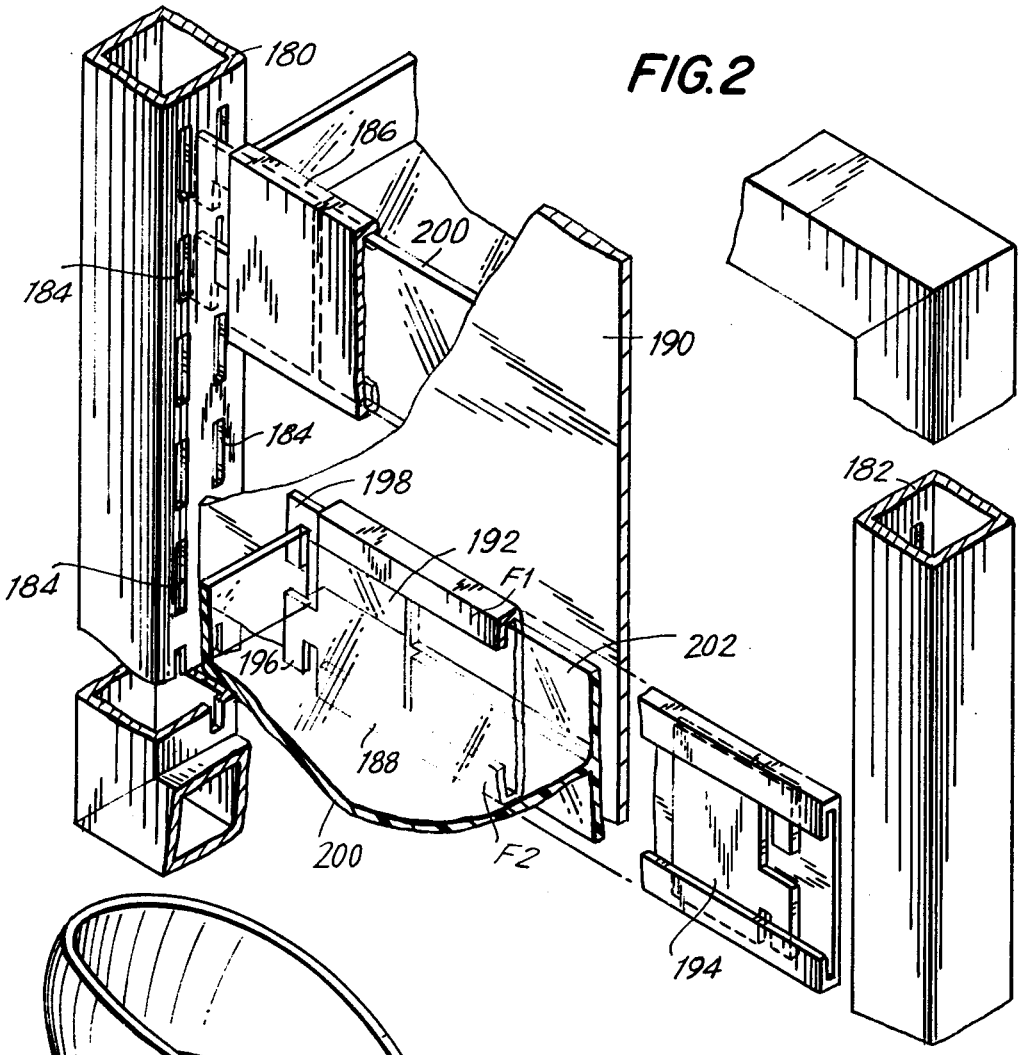
FIG. 2 is a perspective, fragmentary and exploded view of a framework support of the invention, detailing the support of FIG. 1, and employed in association with an article support of the invention.

These sections can be supported on a framework in which guides or rails are adjustably supported. One such framework is illustrated in FIG. 2. The illustrated framework includes two hollow double-slotted vertical channels or columns 180 and 182 each provided with double rows of slots 184. The double row of slots in column 180 faces the double row of slots in column 182. These vertical channels are space and capable of supporting therebetween at selected vertical heights a number of horizontal guides or rails such as indicated at 186 and 188. The guide 186 forms part of one vertical array of guides. The guide 188 likewise forms part of another vertical array of guides. These arrays of guides sandwich therebetween a vertical panel 190 such that displays are positioned on opposite sides of the same.

The panel 190 is thicker by, for example, one thirty-second to one-eighth of an inch than the distance between arrays. As a result the panel 190 is wedged or locked between the arrays. To achieve this result, one array of guides is positioned between the vertical columns. Then the panel is put into position. Next, the second array has to be forced into position as a result of which the panel is wedged between the two arrays. This wedging is facilitated by making the panel of foam (e.g. foamed polystyrene or the like) or of masonite covered by cloth or vinyl thereby permitting a surface compression of the panel.

The panel serves as a replaceable backdrop between arrays. It can be, for example, decoratively covered to correspond to the merchandise displayed or to advertise the displayer. It can be decorated to correspond to seasons, holidays, promotional schemes and so forth. This is all greatly facilitated by the rapidity with which panel 190 can be replaced.

Panel 190 also has a further use. Considering, for example, that the frame constituted by guides 186 and 188 and columns 180 and 182 may be, for example, four feet wide (and perhaps six feet high), the lengths of the guides are such that they can deform in a torsional sense in response to loads such as constituted by the articles supported, as well as by the pairs of support sections mounted on the guides. The panel 190, which is wedged or locked in between the guides, resists this torsional deformation and thereby contributes significantly to the stability of the structure. The panel thus serves not only as a backdrop but as a means to stabilize the guides against torsional deformation.

Inside the opposite ends of the guides, for mounting the guides on the vertical columns, are provided extensible slides such as indicated at 192 and 194. These slides consist of flat bodies which carry hooks 196 and 198 which are selectively engaged, for example, in slots 184. Such guides carry the article support sections, as indicated at 200, which perform as generally indicated above and which include flanges 202 which are fit into the guides.

Figure 3:
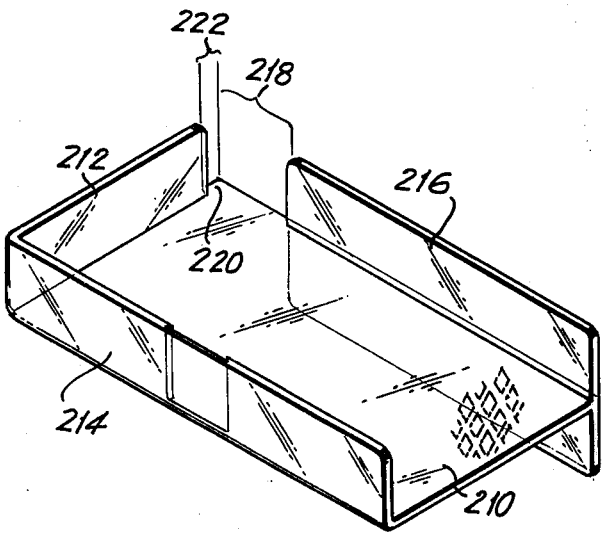
FIG. 3 is a perspective view of an article support section provided in accordance with a preferred embodiment of the invention.

FIG. 3 illustrates in perspective view an article support section employed in accordance with the invention and adapted for being adjustably supported in a guide forming part of a framework or otherwise mounted as has been indicated hereinabove.

The article support section illustrated in FIG. 3 includes a horizontal base 210 with a lateral lip 212 and a front lip 214. Arranged at the rearmost edge of the base 210 is a flange 216 extending above and below the base 210. The function of the flange is to be accommodated in a guide such as has been indicated hereinabove for purposes of supporting the article support section associated therewith.

It will be noted that a portion of the rearmost edge indicated at 218 represents the extension of the rear edge of the base 218 beyond the flange 216. The purpose of this is best seen with reference again to FIG. 2 wherein it can be noted that the guide also accommodates the flat body of the slides upon which are mounted the hooks 196 and 198. The space 218 makes it possible for the base 210 to extend alongside of the flat body of the slide 192 in such a manner that the slide 192 constitutes in effect an extension of the flange 216 whereby the base 210 can extend completely to the ends of the associated guide.

At the same time it will be noted that the lateral edge 220 of the base 210 extends beyond the lateral lip 212 by an amount indicated at 222. This extension 222 is substantially equal to the thickness of the turned-in flanges F1 and F2 (FIG. 2) of the guide so that the lateral lip 212 can extend all the way in against the guide. Thereby, the lateral lip 212 can press against the flanges of the guide and resist forces tending to cause the base 210 to bend or flex relative to the flange 216.

The flange 216 as well as the lips 212 and 214 are preferably fabricated as a monolithic structure with the base 210, with the whole being preferably injection molded from a suitable plastic such as, for example, polystyrene. The article support section illustrated in FIG. 3 is shown in simplistic form, but it will be readily understood that the support so illustrated can be readily formed with rounded edges and corners and in a more decorative form.

It will also be understood that the support illustrated in FIG. 3 is generally one of a pair of which the other section is a mirror image. This means that the two sections, cooperating to support an article, will have lateral lips 212 at opposite and remote edges whereas the front lips corresponding to the lip 214 will generally and preferably be in coplanar relationship.

Figure 4:
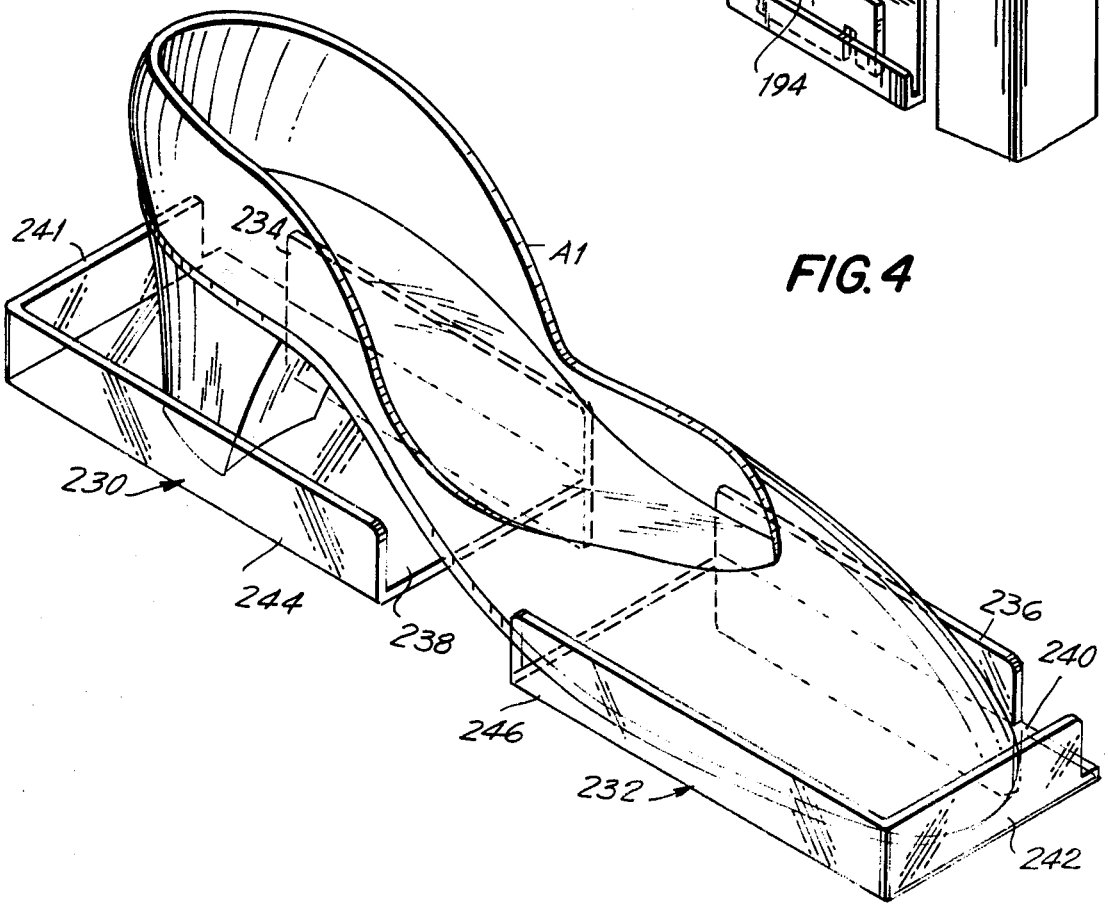
FIG. 4 is a perspective view of two article support sections arranged in a cooperating pair for supporting an article therebetween.

The type of article support section illustrated in FIG. 3 is susceptible of a number of uses. One of these uses is illustrated in FIG. 4 wherein can be seen the support sections 230 and 232. These sections have coplanar flanges 234 and 236 accommodated in the same guide and the bases 238 and 240 are coplanar to support an article A1. The lateral lips 241 and 242 are provided to constrain the article to the support thusly formed as is also further effected by the front lips 244 and 246. Thus it will be noted that the front and lateral lips cooperate with the associated base to form a partial box-like structure in which an article is supported.

Figure 5:
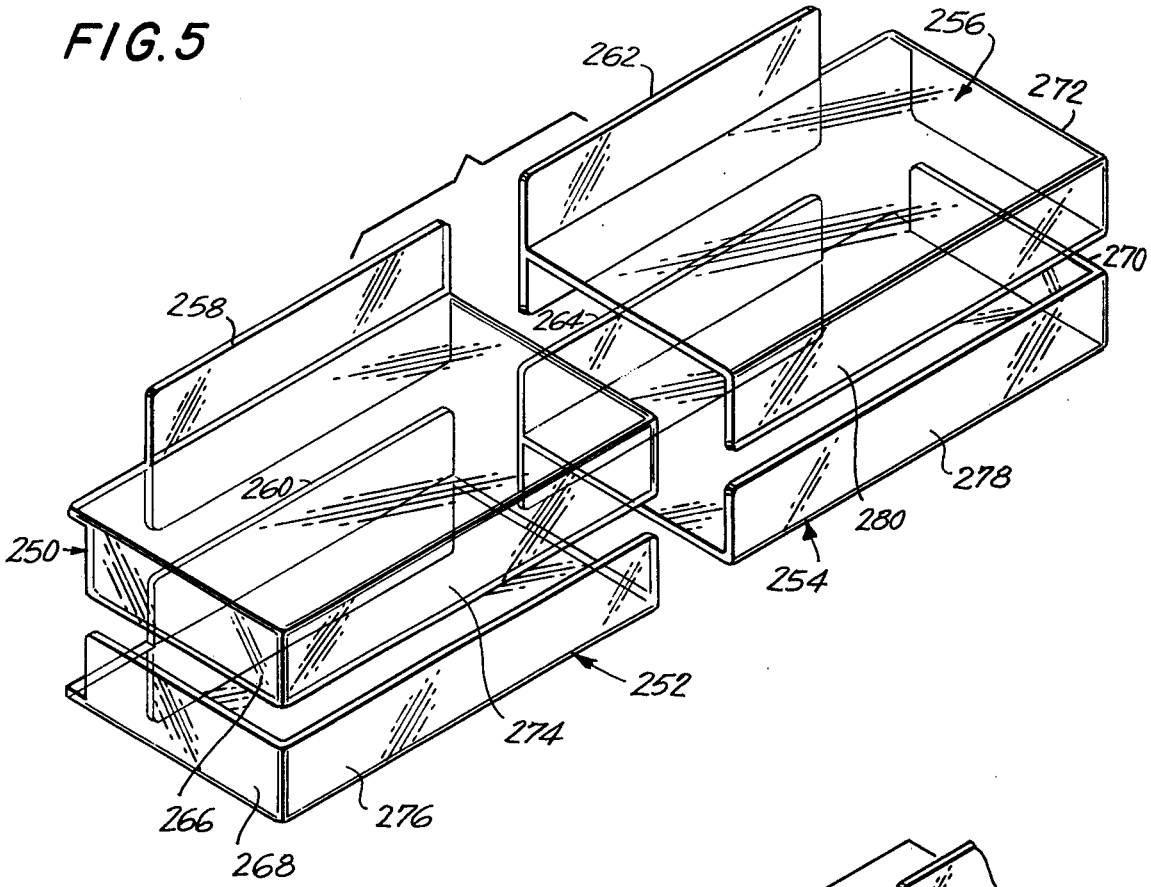
FIG. 5 is a perspective view of four article support sections arranged both in horizontal and in vertical alignment to support articles extending therebetween in horizontal and/or vertical attitude.

FIG. 5 illustrates a further arrangement of the article support sections of the invention according to which use the article support sections may be arranged both in horizontal and/or vertical alignment. Thus, for example, FIG. 5 illustrates sections 250, 252, 254 and 256 respectively including flanges 258, 260, 262 and 264.

Sections 250 and 252 are provided with lateral lips 266 and 268 respectively. Sections 254 and 256 are provided with lateral lips 270 and 272 respectively. The four sections include front lips 274, 276, 278 and 280 all arranged in co-planar relationship. The sections 252 and 254 may be arranged in guides at selected and adjustable distances with respect to one another. Sections 250 and 256 can likewise be arranged in guides at selected distances from one another.

Sections 250 and 252 may be arranged in separate parallel guides which are vertically spaced from one another. In this event the sections 250 and 252 may encase between them an article such as a shoe which is retained therein by means of the lips 276, 268, 274 and 266. Similarly, the sections 254 and 256 may be spaced in respective guides to entrap an article such as a shoe therebetween.

Figure 6:
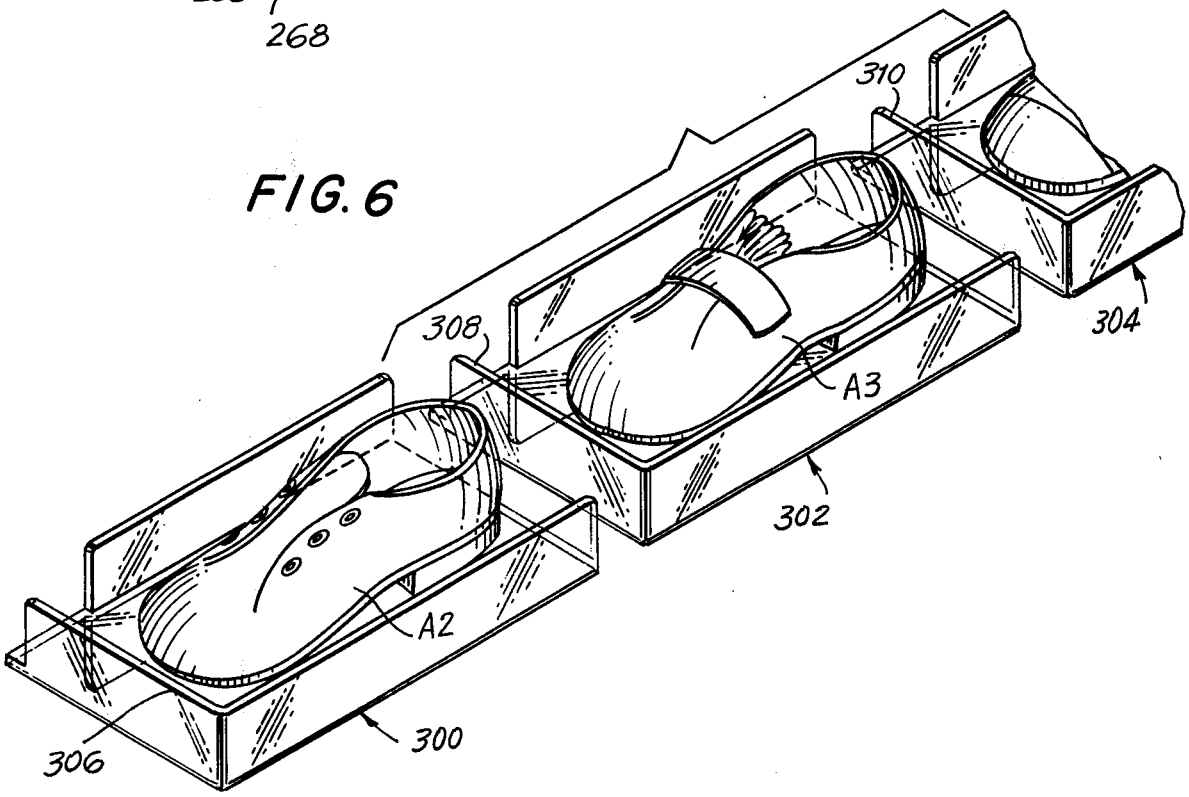
FIG. 6 is a perspective view of a group of three article support sections wherein the sections are adapted to supply retainer walls for one another.

FIG. 6 illustrates the use of three identical article support sections 300, 302 and 304. These all include a lateral lip 306, 308 or 310 on the same respective lateral edge of the corresponding base. In this situation articles such as indicated at A2 and A3 will not normally extend between two such article support sections but will be supported entirely on one section. In this case, however, the lateral lip of one support section will form a retainer wall for the next adjacent article support section so that the various article support sections will provide retainer walls for one another.

From what has been indicated above it will now be seen that there is provided in accordance with the invention an article display comprising cooperating article support sections adapted for supporting an article therebetween with means being provided for holding the sections in adjustably spaced relation.

Such means may include two arrays of horizontal guides arranged in parallel horizontal planes and a panel wedged between the arrays to serve as a backdrop and to avoid the effects of various forces on the guides as they are loaded. The article support sections can be adjustably located in the guides and, for example, may be horizontally and/or vertically spaced therein to form, if desired, cooperating pairs for the cooperative support of articles to be displayed. As has also been indicated the article support sections may work individually with the lateral lips provided on the various article support sections constituting retainer walls for one another.

The preferred sections in accordance with the invention illustrated herein include flanges to ride in respective of the guides with a base extending horizontally from the flange and lateral and front lips on the base to define a box-like structure therewith.

There will now be obvious to those skilled in the art many modifications and variations of the construction set forth hereinabove. These modifications and variations will not depart from the scope of the invention if defined by the following claims.

What is claimed is:

1. An article display comprising cooperating article support sections adapted for supporting an article there-between and means for holding said sections in adjustably spaced relation, said means including two arrays of horizontal guides arranged in parallel horizontal planes and a panel wedged between said arrays, said sections being adjustably located in said guides, each of said sections including a flange adapted to ride in one of said guides, a base extending horizontally from said flange and lateral and front lips on said base to define a box-like structure therewith.

2. An article display as claimed in claim 1 wherein cooperating sections are arranged in pairs in the same guides.

3. An article display as claimed in claim 1 wherein cooperating sections are arranged in pairs in vertically spaced guides.

4. An article display as claimed in claim 2 wherein the lateral flanges in at least one of the pairs are located on remote edges of the corresponding bases.

5. An article display as claimed in claim 2 wherein the lateral flanges in at least one of the pairs are located on corresponding edges of the corresponding bases.

6. An article display as claimed in claim 3 wherein the lateral flanges in at least one of the pairs are located on corresponding edges of the corresponding bases.

7. An article display as claimed in claim 1 comprising vertical columns supporting said guides at selectively adjustable vertical heights, said columns having double rows of slots corresponding to said arrays, slides extensible from said guides and including bodies in said guides and hooks on said bodies and engageable in said slots.

8. An article display as claimed in claim 7 wherein the bases extend beyond the corresponding flanges by an amount at least equal to the bodies of the slides.

9. An article display as claimed in claim 7 wherein the guides include flanges engaging around the flanges of the sections and the bases extend beyond the corresponding lateral lips by an amount at least equal to the flanges of the guides.

10. An article display apparatus comprising a vertical panel, spaced vertical columns at opposite ends of said panel and provided with double rows of slots the slots in one of said columns facing the slots in the other of said columns, panel supports mounted in said slots and sandwiching said panel therebetween and forming with said panel a display support structure, and display means on said structure for displaying articles thereon.

11. An article display apparatus comprising a vertical panel, spaced vertical columns at opposite ends of said panel and provided with double rows of slots, panel supports mounted in said slots and sandwiching said panel therebetween and forming with said panel a display support structure, and display means on said structure for displaying articles thereon, said panel supports being horizontal rails extending between said vertical columns and including retractible hook engaging in respective ones of said slots, said display means being supported by said rails.

12. Apparatus as claimed in claim 11 wherein said display means include a horizontal base and means slidably supporting said base in one of said rails.

13. Apparatus as claimed in claim 12 comprising lateral and front lips on said base.

* * * * *